United States Patent [19]

Bessinger et al.

[11] Patent Number: 4,871,136

[45] Date of Patent: Oct. 3, 1989

[54] INTERLOCK SHELF AND BRACKET

[75] Inventors: Walter L. Bessinger, Grand Haven; Michael J. Hogan, Ada, both of Mich.

[73] Assignee: Knape & Vogt Manufacturing Co., Grand Rapids, Mich.

[21] Appl. No.: 83,374

[22] Filed: Aug. 10, 1987

[51] Int. Cl.[4] ..... A47B 96/06

[52] U.S. Cl. ..... 248/250; 108/108; 108/152; 211/90; 248/205.3

[58] Field of Search ..... 248/250, 235, 205.3; 211/90; 108/27, 114, 151, 152, 108

[56] References Cited

U.S. PATENT DOCUMENTS

| | | | |
|---|---|---|---|
| 569,640 | 10/1896 | Hartzell | 248/250 X |
| 2,747,745 | 5/1956 | Sontheim | 211/90 |
| 3,034,757 | 5/1962 | Suben | 211/90 X |
| 3,295,474 | 1/1967 | Ornstein | 248/205.3 X |
| 3,421,458 | 1/1969 | Salkoff et al. | 108/125 X |
| 3,437,214 | 4/1969 | Sainsbury | 211/90 |
| 4,361,099 | 11/1982 | Kokenge | 248/250 X |
| 4,385,565 | 5/1983 | Roberts et al. | 248/235 X |
| 4,407,476 | 10/1983 | Bohannan | 108/152 X |
| 4,431,155 | 2/1984 | Engel | 248/243 |
| 4,508,301 | 4/1985 | Nicholson et al. | 248/235 X |
| 4,603,781 | 8/1986 | Ryan | 211/90 |
| 4,691,887 | 9/1987 | Bessinger | 248/250 |
| 4,720,069 | 1/1988 | Bessinger | 248/250 |

FOREIGN PATENT DOCUMENTS

| | | | |
|---|---|---|---|
| 811370 | 8/1951 | Fed. Rep. of Germany | 211/90 |
| 1400793 | 7/1969 | Fed. Rep. of Germany | 248/250 |
| 1534774 | 7/1969 | Fed. Rep. of Germany | 52/290 |
| 2749477 | 5/1979 | Fed. Rep. of Germany | 248/235 |
| 2155310 | 9/1985 | United Kingdom | 312/205 |

*Primary Examiner*—Alvin C. Chin-Shue
*Assistant Examiner*—David L. Talbott
*Attorney, Agent, or Firm*—Price, Heneveld, Cooper, DeWitt & Litton

[57] ABSTRACT

A cantilever shelf bracket assembly, of which the vertical wall engagement member, the horizontal platform and the overhanging retention member together define the respective inner end, bottom and top of a shelf receiving throat; a resilient cushion and interlock member adhered to the shelf with one leg extending between the shelf inner edge and the inner end of the throat, and the second leg being between the top of the shelf and the overhanging retention member; there being mutually facing interlock grooves extending in from the ends of the bracket, removable end caps and protrusions that interfit into the interlock grooves for securing the shelf in the bracket.

19 Claims, 3 Drawing Sheets

INTERLOCK SHELF AND BRACKET

BACKGROUND OF THE INVENTION

This invention relates to a cantilever shelf bracket assembly.

Cantilever shelf brackets, although having been known in various forms for some time, have recently become more popular. A bracket for shelves of wood is shown in U.S. Pat. No. 4,508,301. Subsequent development by assignee resulted in the bracket assembly set forth in pending application Ser. No. 895,297 filed Aug. 11, 1986 now U.S. Pat. No. 4,691,887 issued Sept. 8, 1987, and which has been found particularly advantageous and desirable for mounting glass shelves. This latter construction has received enthusiastic reception as a cantilever support for glass shelves. Subsequently, applicant conceived of a novel interlocking cantilever shelf bracket assembly useful for glass or for other materials, and having characteristics enabling it to be formed in a streamlined, compact arrangement with hidden shelf retention interlock features.

RELATED APPLICATIONS

This application is a continuation-in-part application of pending application entitled Shelf Anchor, Ser. No. 895,297 filed Aug. 11, 1986, now U.S. Pat. No. 4,691,887 issued Sept. 8, 1987; of pending application entitled Lock Pin Cantilever Shelf, Ser. No. 898,419 filed Aug. 21, 1986, now U.S. Pat. 4,720,069 issued Jan. 19, 1988; and of pending application entitled Resilient Sleeve Glass Shelf Bracket, Ser. No. 029,237 filed Mar. 23, 1987, now abandoned in lieu of continuation application Ser. No. 097,503 filed Sept. 16, 1987, now U.S. Pat. No. 4,738,426 issued Apr. 19, 1988.

SUMMARY OF THE INVENTION

The present invention is a novel interlocking cantilever shelf bracket assembly exhibiting excellent support and retention of shelves made of glass or other material, while having a compact, streamlined configuration giving the impression of a floating unit. The shelf, with its rear edge portions having a resilient cushion adhered thereto, at least at the opposite ends of the shelf, is fitted into the bracket throat. The cushion has one leg portion between the shelf edge and the throat inner end, and another leg portion between the shelf top and the overhanging retention member of the bracket. The overhanging retention member and the adjacent leg portion have superposed recesses to receive laterally inserted locking elements, thereby interlocking the shelf in the bracket. Specifically, the cushion and the bracket have mutually facing, superposed contiguous grooves which receive laterally inserted locking protrusions to interlock the shelf and bracket.

DESCRIPTION OF THE PREFERRED EMBODIMENTS

First Embodiment

Figure 1:
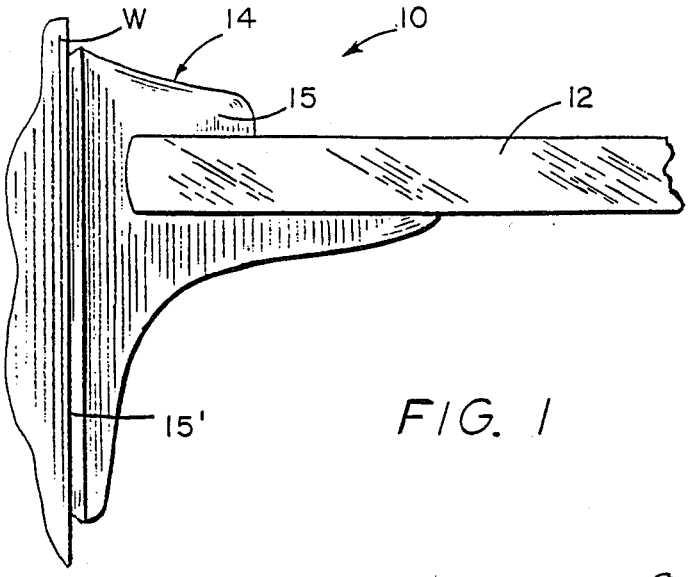
FIG. 1 is an end elevational view of the first embodiment of the novel bracket assembly complete with an inserted shelf and end caps.
Figure 2:
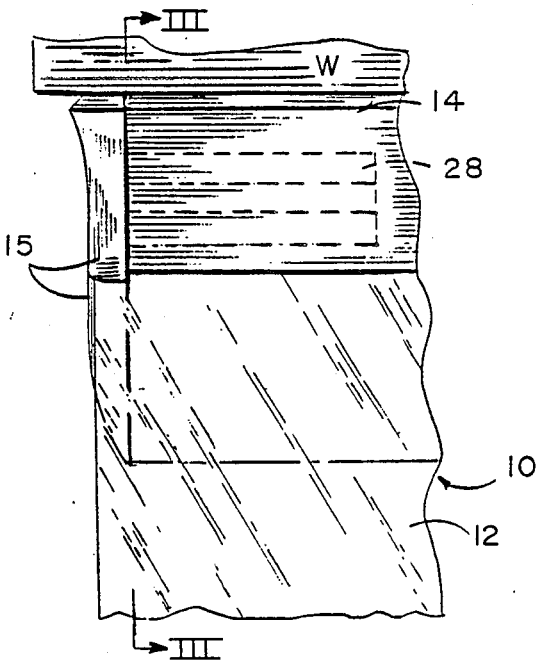
FIG. 2 is a fragmentary plan view of the assembly in FIG. 1.

The shelf and bracket assembly 10 depicted in FIGS. 1 and 2 is shown mounted to a wall W. The bracket and shelf assembly include shelf 12 of glass, wood, pressed board, or other composite or the equivalent, and bracket 14 with end caps 15.

Bracket assembly 14 includes a generally vertical member 16 having wall engaging surfaces **16*a*, 16*b* and 16*c*, shown vertically spaced from each other. Wall engaging surface 16*a* is behind shelf 12 while surfaces 16*b* and 16*c* are rearward protrusions from the downwardly depending portion of vertical member 16. Integral with and extending horizontally from wall engaging member 16 is platform 18 having an upper platform surface 18*a* forming the bottom of a generally U-shaped throat that receives the inner end and adjacent edge portion of elongated shelf 12. The bottom of platform 18 curves downwardly-rearwardly into vertical member 16. Also extending generally horizontally from member 16 is an upper, platform-overhanging, retention member 20 which projects only a fraction, usually no more than half, of the width (i.e. away from the wall) of platform 18**, and spaced vertically thereabove an amount equal approximately to the thickness of the shelf to be inserted plus the thickness of the upper leg of a resilient cushion member to be described.

Bracket 14 comprises an integral member formed of extruded aluminum or the equivalent, and having a length (i.e. along the wall) preferably several times its height or width. Orifices 16d extend through vertical member 16 at spaced intervals to receive threaded screw fasteners 24 (FIG. 3) for attachment of the bracket to wall W. These orifices are shown located in the throat to be hidden directly behind the shelf.

Extending along the rear edge portion of the shelf, optionally its entire length but at least at the opposite ends thereof, is interlock cushion 28 of a resilient polymeric material such as rubber or plastic. Each cushion member is shown to have an upper leg portion **28*a* positioned between the upper rear surface of shelf 12 and the lower underside horizontal overhanging surface of retaining member 20, and a second leg portion 28*b* extending vertically down between the rear edge of the shelf and the inner end of the bracket throat, including the space between the head of fasteners 24 and the shelf. This isolates the shelf from the fasteners and any inner end portions of the throat which might cause scratching, particularly on glass shelves, to create excess stress points for possible breakage. The upper horizontal leg portion 28a of this resilient member has a laterally extending, horizontal groove 28' in its upper surface coinciding with, i.e. superposed on, a downwardly facing, laterally extending groove 20' in the under surface of retainer 20**. The grooves extend longitudinally of the bracket and cushion, i.e. transversely of the normal insertion and removal direction of the shelves which is toward and away from wall W. The grooves are thus basically parallel to the wall surface. The cooperative facing grooves receive locking pins or protrusions on the end caps. The locking pins have vertical dimension sufficient to extend into both grooves.

Resilient members 28 are adhered to the shelf 12 by a suitable contact adhesive or the equivalent. In shipping the product, the adhesive, which is previously applied to the legs of member 28, can be protectively covered by a layer of removable stock such as paper or the like, enabling the final assembler to readily attach the cushions to the shelf after removal of the protective paper.

Figure 3:
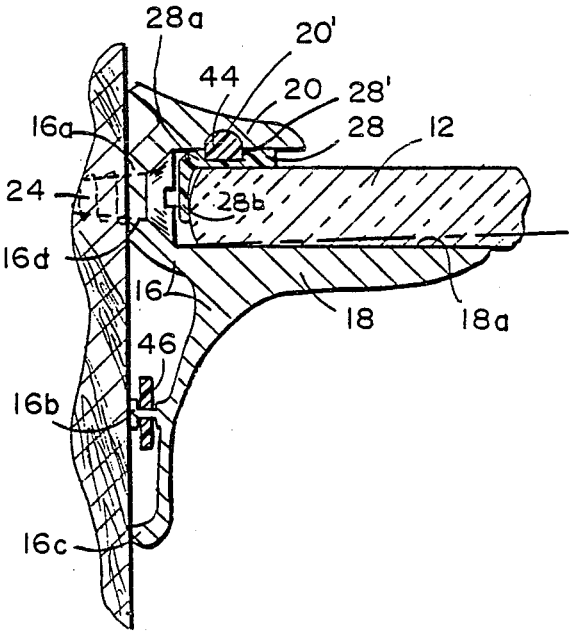
FIG. 3 is a fragmentary elevational end view of the assembly in FIG. 1, taken on plane III—III of FIG. 2 so as to be without the end cap.
Figure 4:
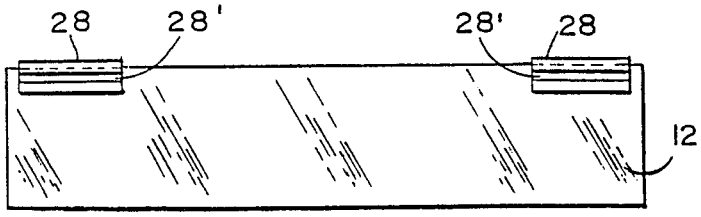
FIG. 4 is a greatly reduced plan view of a shelf having the resilient interlock cushions adhered thereto at the opposite ends thereof.
Figure 6:
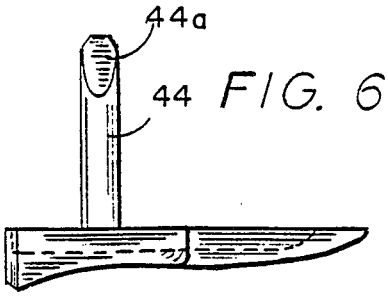
FIG. 6 is a plan view of the end cap in FIG. 5.
Figure 5:
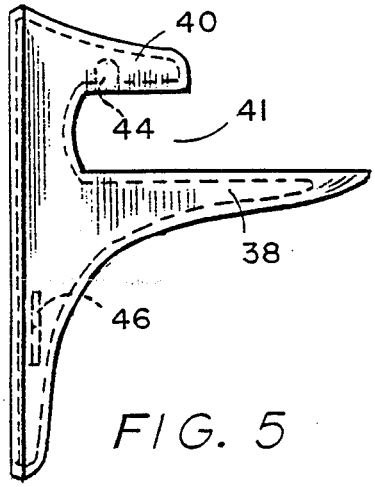
FIG. 5 is an elevational view of an end cap of FIG. 1.
Figure 7:
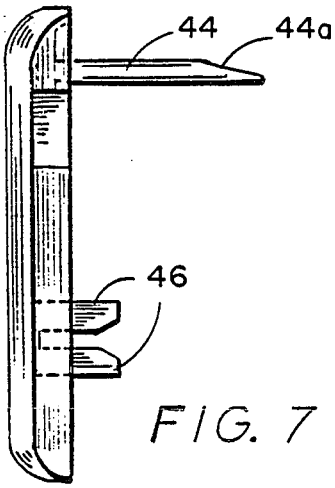
FIG. 7 is a front elevational view of the end cap in FIGS. 5 and 6.

End caps 15 for the opposite ends of the assembly are of mirror image to each other. The left end cap is illustrated in detail in FIGS. 5–7. The right end cap is a mirror image thereof and therefore not depicted. Each end cap has a configuration generally comparable to that of the bracket end. The space 41 between the horizontal, forwardly projecting portion 38 and the upwardly spaced, horizontal, forwardly projecting portion 40 has a height comparable to the thickness of shelf 12. The rear edge 15' of end cap 15 can be vertically straight as depicted or otherwise configurated. Above space 41 is a horizontal locking protrusion or pin 44 which extends transversely to the end cap, i.e. parallel to the wall. It is spaced forwardly from rear edge 15' the same amount as grooves 20' and 28' are from the wall, to coincide therewith. The pin has a tapered outer free end 44a for insertion into both grooves 28' and 20' in resilient cushion member 28 and retention member 20 respectively, as depicted in FIG. 3. This insertion occurs during attachment of the end caps to the end of the shelf and bracket assembly, to lock the shelf against removal by interlocking these components. The end cap is preferably retained on the bracket by having a U-shaped protrusion on the end cap forming a pair of resilient snap legs 46 to snap over a web portion of protrusion 16b of the bracket (see FIGS. 7 and 3).

The assembly operation for this simple and effective mounting apparatus is readily performed. Typically the bracket assembly including screw fasteners, bracket, resilient cushion strip and end caps are to be shipped separately or with a shelf. To mount the assembly on the wall, the bracket is attached by extending screw fasteners 24 through the openings provided in element 16a of vertical web 16 at spaced locations in the elongated bracket. Cushion elements 28 are then adhered to at least the end portions of the rear edge of the shelf, or optionally along its entire length. The shelf rear edge with the adhered cushions is then inserted toward the wall into the bracket throat defined by platform 18, vertical member 16 and retention member 20, thereby aligning the grooves in cushion member 28 and retention member 20. End caps are then snapped onto both ends using fasteners 46 or the equivalent, causing locking protrusions 44 to be inserted into both of the matching grooves for locking the assembly. The shelf cannot therefore be withdrawn away from the wall due to engagement of the abutting surfaces of the locking means. The finished assembly is attractive, streamlined and effective against removal of the shelf until desired.

Removal can be achieved simply by releasing and removing the end caps, thereby unlocking the shelf to allow it to be withdrawn from the bracket throat, followed by sliding the shelf out of the bracket.

If desired, the surface 18a of platform 18 can be formed, e.g. extruded at a slight upwardly-outwardly inclined acute angle as shown by the phantom line in FIG. 3 so that, with the load of the shelf and objects thereon, the bracket can deflect slightly to a true horizontal orientation by flexure of the downwardly, rearwardly curved support.

Second Embodiment

Figure 10:
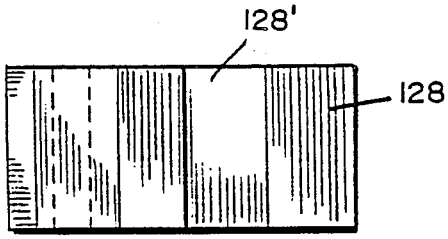
FIG. 10 is a plan view of the member in FIG. 9.
Figure 8:
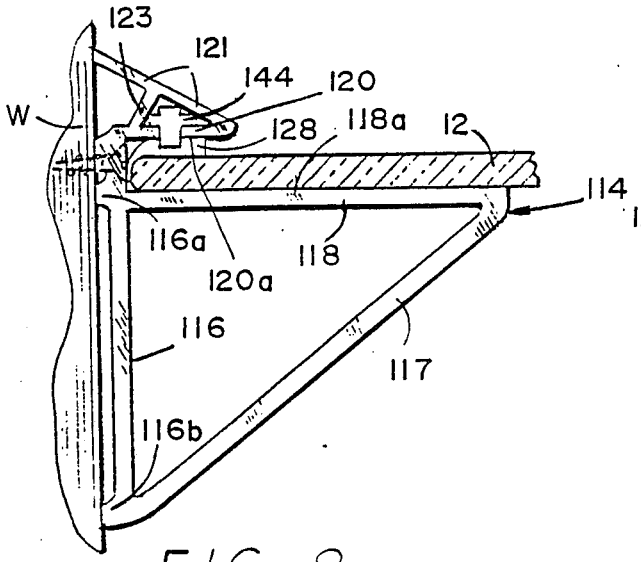
FIG. 8 is an end elevational view of a second embodiment.
Figure 9:
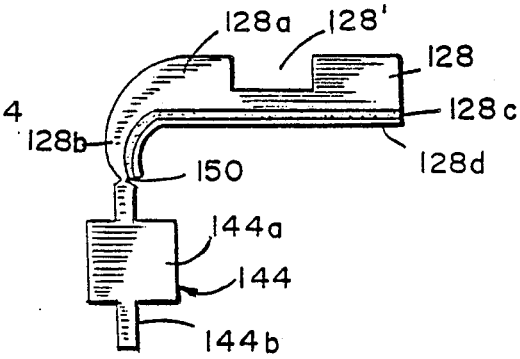
FIG. 9 is an enlarged end elevational view of a polymeric member formed to include separable resilient cushion and interlock elements.

The embodiment depicted in FIGS. 8–10 comprises a shelf and bracket assembly 110 shown mounted to wall W and including shelf 12, bracket 114 and end caps (not shown). Bracket 114 is an elongated integral structure as of extruded aluminum. It has a vertical member 116 with wall engaging web surface 116a behind the shelf throat and lower, wall engaging surface 116b. A plurality of laterally spaced orifices extend through web surface 116a for receiving threaded fasteners to secure the bracket to the wall.

Extending forwardly, away from the wall, is horizontal platform 118 having an upper surface 118a. An optional integral diagonal brace 117 is shown to extend between the outer end of platform 118 and the lower part of member 116.

Also extending horizontally and forwardly is a retention member 120 having a lower retention surface 120a. An upwardly rearwardly projecting web 121 extends from the outer edge of member 120 toward wall W. Web 121 is also joined to member 120 by a cross tie web 123, to the rear of an elongated slot in member 120. This slot forms part of a recess that extends lengthwise of member 120 to receive locking protrusion 144 in the manner described hereinafter.

Interlock cushion 128 has a top horizontal leg and a rear vertical leg, being of resilient polymeric material such as rubber or plastic. Upper leg 128a is positioned between the upper rear surface of shelf 12 and the lower underside surface of retaining member 120. Rear leg 128b extends down over the inner end of the bracket throat to be between the inner rear edge of the shelf and the end of the throat as well as the screw fasteners, to cushion shelf insertion and prevent shelf scratching. The bottom of leg 128a and the front of leg 128b have an adhesive coating 128c (FIG. 9) for attachment to the shelf rear edge, covered by a protective removable layer 128d as of paper. The top of leg 128a has an upper groove 128' extending lengthwise of the shelf, i.e. parallel to the vertical member 116, coincident with recess or groove 120'.

Locking member 144 has a main body 144a (FIG. 9), and a pair of opposite side flanges 144b extending from the body. It is insertable lengthwise into recess 120' so that flanges 144b rest on panel member 120 while a lower portion of body 144a depends beneath surface 120a to protrude into groove 128'. This interlocks the shelf and bracket. Locking member 144 may be part of an end cap (not depicted) if desired. Alternatively it may be an extruded or molded member. In fact, it can be formed integral with interlock cushion 128, joined thereto at a frangible joint or web 150 for separation just prior to use.

Assembly of the apparatus is readily achieved by first mounting bracket 114 to wall W with threaded fasteners, adhering cushion interlock members 128 to at least the end portions of the shelf rear edge, inserting the shelf rear edge and cushions into the bracket throat, and superimposed elongated recesses 120' and 128'. Disassembly is accomplished by reversing the order of these steps.

Third Embodiment

Figure 11:
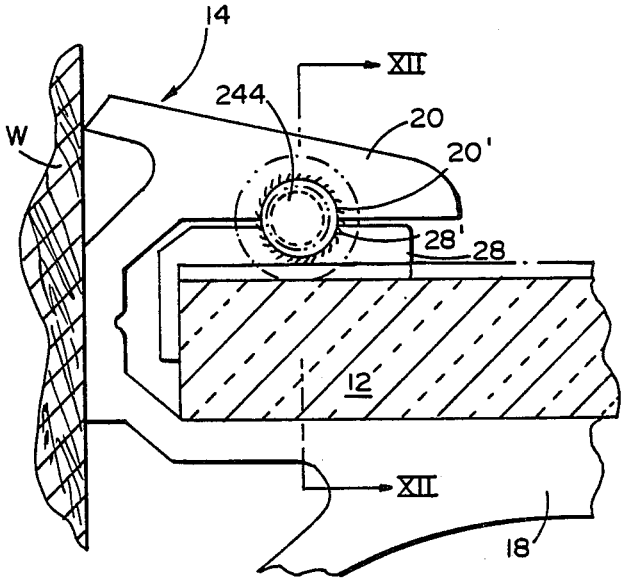
FIG. 11 is an end elevational view of a third embodiment.
Figure 12:
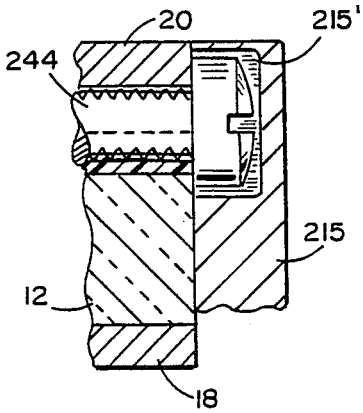
FIG. 12 is a fragmentary sectional view of the third embodiment taken on plane XII—XII of FIG. 11.

In FIGS. 11 and 12 is depicted a third embodiment which is a modification of the first embodiment described above. Shelf bracket 14 in this third embodiment is basically the same as that in the first embodiment, and is secured to the wall by threaded fasteners in the same manner. The shelf 12 is mounted on platform 18 and has adhered thereto the interlock cushion 28. Shelf 12 is illustrated as having two different thicknesses, one being the thinnest and the other the thickest to normally be encountered due to manufacturing tolerance variations during glass fabrication. As indicated previously, the bracket assembly is particularly suitable for glass shelving, although it could conceivably be used for shelving of other materials such as wood, composite or the like.

The upper surface of the upper leg of interlock cushion 28 has the groove 28', while the lower surface of retention member 20 has the coinciding groove 20' as in the first embodiment. In this third embodiment, however, the locking member or protrusion 244 constitutes a threaded member or screw preferably of the shelf threading sheet metal type. A protruding head such as a filister head for the screw is depicted in FIG. 12. These threaded locking members 44 are inserted from the opposite directions, extending laterally into the superposed grooves 20' and 28' to lock the shelf in position. The screw threads provide means to generate a downward force on the glass shelf while compensating for the varying tolerance of the glass thickness and for the varying tolerance of the groove 20' in the aluminum extrusion of which the bracket is preferably formed. The threaded member applies this downward biasing force by depressing the underlying portion of the upper leg of cushion 28 against shelf 12. The screw also enables use of a longer locking member than a polymeric locking member which is formed integral with the end caps. End caps 215 for this embodiment include a cavity 215' on the inside face of the end cap, aligned with the head of this locking member to receive the head and allowing the end cap to fit flush against the end of the bracket 24. The end cap may be attached to the bracket in the same fashion as depicted at 46 and **16*b* in FIG. 3** for the first embodiment.

Assembly of this third embodiment is made by securing the bracket to the wall, adhering interlock cushion 28 to shelf 12 at least at the opposite ends of the shelf, followed by inserting the shelf and interlock cushion into the throat of the bracket. Then the threaded interlock elements 244 are threadably inserted longitudinally of the bracket, i.e. laterally into both grooves 20' and 28' which are parallel to wall W, to lock the shelf in place. Finally, any end caps are attached over the end of the bracket, shelf and interlock elements to complete the assembly.

Conceivably certain other details of this construction could be modified within the concept presented, to suit a particular application or installation. Thus, the invention is intended to be limited only by the scope of the appended claims and the reasonably equivalent structures to those defined therein.

The embodiments of the invention in which an exclusive property or privilege is claimed are defined as follows:

1. A cantilever shelf bracket assembly comprising a bracket having a vertical wall engagement member, a shelf support platform protruding horizontally from said wall engagement member, and a shelf retainer protruding horizontally from said wall engagement member, overhanging said platform and spaced therefrom;

said wall engagement member, said platform and said retainer defining a throat for receiving an edge portion of a shelf;

a cushioning interlock means in said throat for cushioning the shelf in said throat and interlocking the shelf within said throat, comprising a resilient cushion located at least at the ends of said throat, having a first leg engageable between the shelf inner edge and said wall engagement member, and having a second leg engageable between said shelf retainer and the top of the shelf;

said resilient cushion having an adherent character allowing said cushion to be adhered to the shelf;

said second leg and said shelf retainer having mutually facing grooves extending lengthwise of said bracket from the ends thereof; and interlock means in said grooves for locking a shelf to which said cushion is adhered, into said bracket.

2. The bracket assembly in claim 1 wherein said resilient cushion is L-shaped.

3. The bracket assembly in claim 2 including end caps at the ends of said bracket, each having a protrusion extending therefrom to form an interlock element.

4. The bracket assembly in claim 2 wherein each L-shaped member has adhesive thereon for attachment to the shelf.

5. The bracket assembly in claim 3 wherein said end caps have a flexible fastener engageable with said bracket for removable securement thereto.

6. The bracket assembly in claim 1 wherein said interlock means comprises threaded members threadably insertable into said grooves at the ends of said bracket.

7. The bracket assembly in claim 6 wherein said grooves extend laterally into said assembly from the ends of said bracket, and said threaded members when inserted deflecting said resilient cushion toward said throat to apply a bias on a shelf therein.

8. A cantilever shelf bracket assembly comprising a bracket having a vertical wall engagement member, a shelf support platform protruding horizontally from said wall engagement member, and a shelf retainer protruding horizontally from said wall engagement member, overhanging said platform and spaced therefrom;

said wall engagement member, said platform and said retainer defining a throat for receiving an edge portion of a shelf;

a cushioning interlock means in said throat for cushioning the shelf in said throat and interlocking the shelf within said throat, comprising a resilient cushion located at least at the ends of said throat;

said resilient cushion having an adherent character allowing said cushion to be adhered to the shelf;

interlock means for locking a shelf to which said cushion is adhered, into said bracket;

said bracket and said cushioning interlock means defining locking groove means extending longitudinally of said assembly for receiving interlock elements; and said interlock means comprising locking elements for insertion into said locking groove means.

9. The bracket assembly in claim 8 wherein said cushion member has adhesive thereon for attachment to the shelf.

10. The bracket assembly in claim 8 including end caps at the ends of said bracket.

11. The bracket assembly in claim 10 wherein said end caps have a flexible fastener engageable with said bracket for removable securement thereto.

12. The bracket assembly in claim 8 wherein said interlock means comprises threaded members threadably insertable into said grooves at the ends of said bracket.

13. A cantilever shelf and shelf bracket assembly comprising a shelf having an inner edge;

a bracket having a wall engagement member, a support platform, and a shelf retainer overhanging said platform, respectively defining the inner end, bottom and top of a shelf receiving throat;

an adherent resilient member in said throat, including a first portion between said throat inner end and said shelf inner edge, and a second portion between said bracket overhang and the top of said shelf;

said resilient member having adhesive thereon securing said resilient member to the shelf;

said resilient member and said bracket overhang having contiguous mutually facing recesses therein; and removable interlock protrusions in both said contiguous recesses for locking said shelf into said bracket.

14. The assembly in claim 13 including removable end caps on said brackets, having portions forming said interlock protrusions, and having disengageable fastener means engageable with said bracket.

15. The assembly in claim 13 wherein said recesses extend laterally of said bracket so as to be parallel to the wall.

16. The assembly in claim 13 wherein said interlock protrusions comprise threaded members threadably insertable into said grooves at the ends of said bracket; and wherein said grooves extend laterally into said assembly from the ends of said bracket, and said threaded members when inserted deflecting said resilient cushion toward said throat to apply a bias on a shelf therein.

17. An elongated cantilever shelf support for a shelf having a rear portion comprising:

a bracket having a laterally oriented throat to receive the rear portion of a shelf;

said throat having a lower support platform forming a bottom, an upper overhang forming a top and an inner end; and a resilient interface strip in said throat;

said interface strip having an upper wall for engagement between said upper overhang and the top of the shelf rear portion, and having a rear wall forming a cushion between the rear edge of the shelf and said throat inner end;

interlock means between said throat top and said upper wall for restraining the shelf against removal from said bracket.

18. The shelf support in claim 17 wherein said interlock means comprises interfitting rib and groove means extending laterally of said bracket for restraining the shelf against movement transverse to said rib and groove means.

19. The shelf support in claim 17 wherein said interlock means comprises interfitting abutting surfaces extending laterally of said bracket for restraining movement of the shelf transverse to said abutting surfaces.

* * * * *

UNITED STATES PATENT AND TRADEMARK OFFICE

CERTIFICATE OF CORRECTION

PATENT NO. : 4,871,136

DATED : October 3, 1989

INVENTOR(S) : Walter L. Bessinger and Michael J. Hogan

It is certified that error appears in the above-identified patent and that said Letters Patent is hereby corrected as shown below:

Column 5, line 5;
After "and" insert -- laterally inserting interlock member 144 into both --;

Column 5, line 31;
"shelf" should be -- self --;

Column 5, line 51;
"bracket 24" should be -- bracket 14 --.

Signed and Sealed this

Sixteenth Day of April, 1991

*Attest:*

HARRY F. MANBECK, JR.

*Attesting Officer*

*Commissioner of Patents and Trademarks*